United States Patent [19]

Russell

[11] 4,456,123

[45] Jun. 26, 1984

[54] METHOD AND APPARATUS FOR DISPENSING FASTENERS

[75] Inventor: David B. Russell, Southborough, Mass.

[73] Assignee: Dennison Manufacturing Company, Framingham, Mass.

[21] Appl. No.: 300,408

[22] Filed: Sep. 8, 1981

Related U.S. Application Data

[62] Division of Ser. No. 071,458, Aug. 31, 1979, Pat. No. 4,288,017.

[51] Int. Cl.[3] ..... B65D 85/24

[52] U.S. Cl. ..... 206/343; 206/348; 206/820; 24/72.7; 24/150 FP

[58] Field of Search ..... 206/343, 348, 820, 338; 24/15 FD, 72.7, 102 A, 201 A, 20 R

[56] References Cited

U.S. PATENT DOCUMENTS

| | | | |
|---|---|---|---|
| 2,940,081 | 6/1960 | Juilfs | 206/343 |
| 3,532,212 | 10/1970 | Gatton et al. | 206/343 |
| 3,850,297 | 11/1974 | Merser | 206/343 |
| 4,039,078 | 8/1977 | Bone | 206/343 |
| 4,347,932 | 9/1982 | Furutu | 206/343 |

*Primary Examiner*—Joseph Man-Fu Moy

*Attorney, Agent, or Firm*—George E. Kersey; Arthur B. Moore; Barry D. Josephs

[57] ABSTRACT

An improved system is described for attaching price tags to garments and for other joining applications using plastic fasteners dispensed through hollow, slotted needles. The system comprises a new method and tool for dispensing fasteners supplied in long lengths, together with improved fastener stock adapted for use therewith and for molding in continuous lengths.

10 Claims, 22 Drawing Figures

METHOD AND APPARATUS FOR DISPENSING FASTENERS

This is a division, of Ser. No. 071,458, filed Aug. 31, 1979 now U.S. Pat. No. 4,288,017.

BACKGROUND OF THE INVENTION

In recent years a large and successful business has been developed which employs flexible plastic fasteners of a type designed to be inserted through hollow slotted needles for tagging or for joining two objects together. Such fasteners, together with apparatus for applying them, have been widely employed for the attachment of buttons to garments, for price tagging in retail establishments, for the pairing of items such as shoes, and in various industrial applications. Such fasteners and apparatus are shown in numerous references, including among others, U.S. Pat. Nos. 3,103,666; 3,399,432; 3,380,122; 3,444,597; 3,457,589; 3,470,834; 3,659,769; 3,733,657; 3,759,435; 3,875,648; 3,893,612; 3,895,753; and 3,948,128.

Most conveniently, plastic fasteners have been provided in assemblies for feeding sequentially through the dispensing apparatus. They have been supplied, as shown for example in U.S. Pat. No. 3,103,666, attached by means of severable necks to a runner bar, or, as described for example in U.S. Pat. 3,875,648, as a stock of continuous side members cross-coupled by a plurality of filaments, from which individual fasteners are severed. Fastener assemblies employing runner bars limit the number of fasteners which can be conveniently supplied in a single assembly and waste material since the runner bar is not put to productive end use. While these limitations are partially overcome by the fastener stock described in U.S. Pat. No. 3,875,648, a need has persisted for improvements in manufacture and in feeding and dispensing the fasteners, especially for applications such as price tagging where a single fastener end-bar is dispensed by means of a hand powered tool.

SUMMARY OF THE DISCLOSURE

Principle objects of the present invention are to provide improved methods and apparatus for feeding, severing and dispensing fasteners furnished in long length, and to provide fasteners of improved design suitable for economic manufacture and for use in the improved method and apparatus.

Fastener stock, as disclosed in U.S. Pat. No. 3,875,648, comprises two continuous elongated plastic side members cross-coupled by a plurality of filaments or cross-links, the stock being proportioned to be fed as a unit to a position where individual fasteners are separated therefrom within a machine, at least one of the side members being proportioned so that each separated fastener includes an end-bar formed from a portion of the side member and is configured for feeding through the bore of a hollow needle having a longitudinal slot for passage of the associated filament, and in which each filament is foldable toward the associated end-bar for feeding through the hollow needle. Preferably, and as shown, the filaments and end-bars are substantially circular in cross-section.

According to the present improvement, the cross-sections are modified such that one side of each filament is a substantially flat surface corresponding to the parting line of the mold in which they are formed. The filament cross-section is substantially D-shaped and provides draft on surfaces extending from the plane to facilitate removal from the mold. The side members are reduced in cross-sectional area between individual fasteners to provide severable connectors to facilitate separation The connectors join the end-bars of adjacent fasteners end-to-end at a portion of their periphery, preferably having a flat face at said plane extending from said plane on either the same side as the filaments or the opposite side thereof. Preferably they extend from the same side and the joined end-bars are substantially D-shaped. Where the connectors extend from the opposite side, the section thereof is preferably continued across the joined end-bars to provide a more rounded cross-section for feeding through circular needle bores. The filaments may be stretched, if desired, after forming to reduce their size and increase their strength as previously disclosed. Filament stock so proportioned is adapted for continuous molding in endless lengths and is well adapted for feeding, severing and dispensing by the method and apparatus hereinafter described.

According to a further aspect of the present invention, the novel method of dispensing fasteners comprises advancing a fastener from a first position remote from the needle to a second position adjacent the rear portion of the needle bore with the end-bar transversely disposed thereto, aligning the end-bar with said bore, severing said connector and forcing said end-bar through said bore. Preferably the connector is restrained from substantial movement, and the end end-bar is rotated about said connector which acts as a hinge.

Apparatus for practicing the method comprise a casing, a dispensing hollow slotted needle mounted to the casing, means for advancing a fastener to a position adjacent the rear of the needle bore with its end-bar transversely disposed to the longitudinal axis of the bore, means for aligning the end-bar with the needle bore, and means for dispensing the end-bar through the bore. Preferably the apparatus comprises a feed wheel, an aligning means comprising a reciprocating cam slide which also actuates the feed wheel, a dispensing means comprising a plunger carried by a reciprocating support which also actuates the cam slide, and means for reciprocating the support. Preferred embodiments are more fully described hereinafter.

DESCRIPTION OF THE PREFERRED EMBODIMENTS

Figure 1:
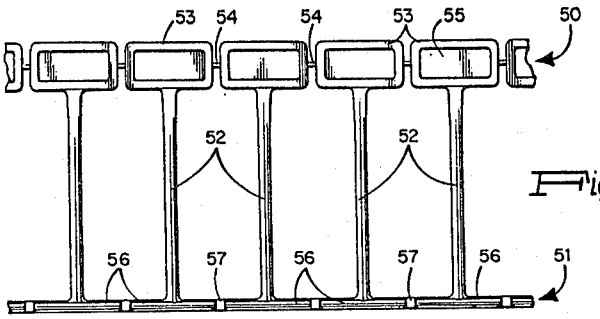
FIG. 1 is a plan view of a first embodiment of fastener stock according to this invention.

Referring to FIGS. 1–6, one embodiment of the fastener stock of the present invention is shown which comprises elongated, continuous side members 50 and 51 cross-coupled by a plurality of cross-links or filaments 52. Side member 50 comprises a plurality of tab or paddle end members 53 joined together by severable connectors 54, one face of the tabs 53 being optionally embossed at 55 for inclusion of identification or decoative matter. Side member 51 comprises a plurality of end-bars 56 joined together by severable connectors 57.

Figure 4:
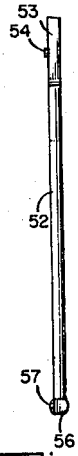
FIG. 4 is an end view of the stock of FIG. 1.
Figure 4A:
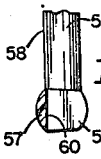
FIG. 4A is an enlarged view of one end of FIG. 4.
Figure 5:
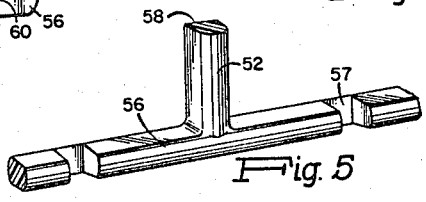
FIG. 5 is a perspective view of a portion of the fastener stock of FIG. 1 illustrating one end-bar and its associated connectors.
Figure 6:
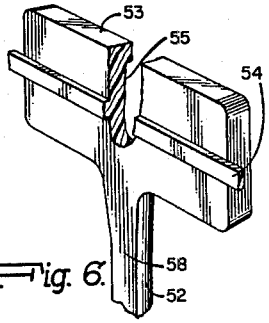
FIG. 6 is a perspective view of a portion of the other end of the fastener stock of FIG. 1.

As shown for example in FIG. 5, the filaments 52 are approximately D-shaped in cross-section with the maximum width at a substantially flat plane 58 at one side thereof. The remainder of their cross-section decreases in width from the plane 58 to the other side thereof and may be of any suitable shape, including converging curves, lines or combinations thereof Preferably the end-bar 56, as shown for example in FIG. 4A, is larger in cross-section than the filament 52 and also has its widest parallel cross-section dimension 60 in the plane 58. As shown in FIG. 6, tab ends 53 are also flat and have their greatest cross-sectional dimension at the plane 58.

In the embodiment of FIGS. 1–6, tab connectors 54 and end-bar connectors 57 have one face at the plane 58, are substantially thinner than either filament 58, cross-bar 56, or tab 53, and extend away from the plane 58 on the side thereof opposite to the body of filament 52. They also extend continuously not only between adjacent tabs 53 and adjacent end-bars 56, but also extend across end-bars 56 and tabs 53 respectively. Such extension provides a more rounded end-bar 56 (see FIG. 4A) and can be molded as continuous runners as hereinafter described.

Figure 2:
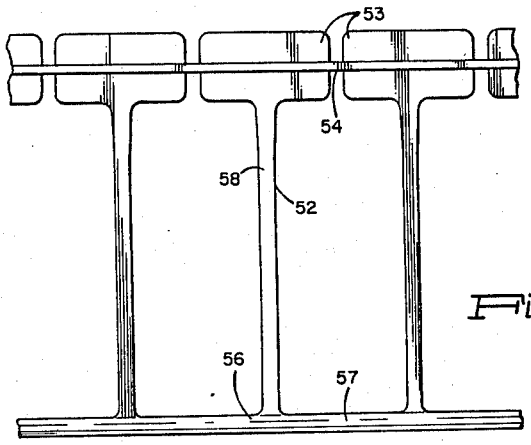
FIG. 2 is a rear view of the fastener stock of FIG. 1.
Figure 3:
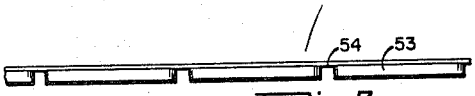
FIG. 3 is a side view of the stock of FIG. 1.
Figure 7:
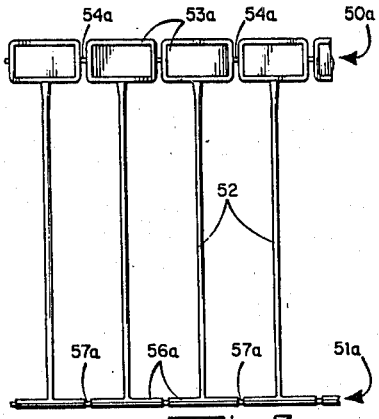
FIG. 7 is a plan view of a second embodiment of fastener stock according to the present invention.

As shown in FIGS. 1, 2 and 7, the filaments 52 may be molded somewhat wider and of greater circumferential dimension adjacent tabs 53 than at end-bars 56 to facilitate stretching adjacent the end-bars where the filaments are folded during dispensing through a hollow needle.

Figure 8:
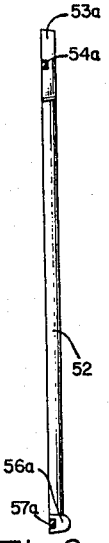
FIG. 8 is a side view of the embodiment of FIG. 7.
Figure 8A:
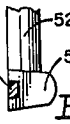
FIG. 8A is an enlarged view of one end of FIG. 8.

A second embodiment of fastener stock of the present invention is shown in FIGS. 7, 8 and 8A which is identical to the fastener stock shown in FIGS. 1–6 except that severable connectors 54*a* and 57*a* extend from the plane 58 in the same direction as the body of filament 52 and do not extend visibly across either end-bars 56*a* or tabs 53*a*. This embodiment is most preferred.

Figure 9:
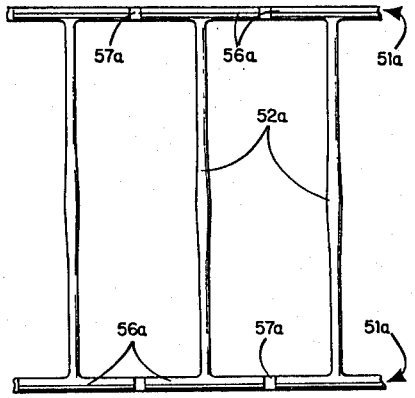
FIG. 9 is a plan view of a third embodiment of fastener stock.

A third embodiment of fastener stock is shown in FIG. 9 in which two side members 51*a* are employed to provide end-bars at both ends of the filament 52*a*. In this embodiment, the filament 52*a* is molded somewhat wider at its mid-portion and is somewhat narrower or smaller in circumferential dimension adjacent each end-bar to facilitate stretching and strengthening of the filament 52 at those portions which are folded during dispensing. In all other respects, the embodiment of FIG. 9 is identical to the embodiment of FIG. 7.

Figure 10:
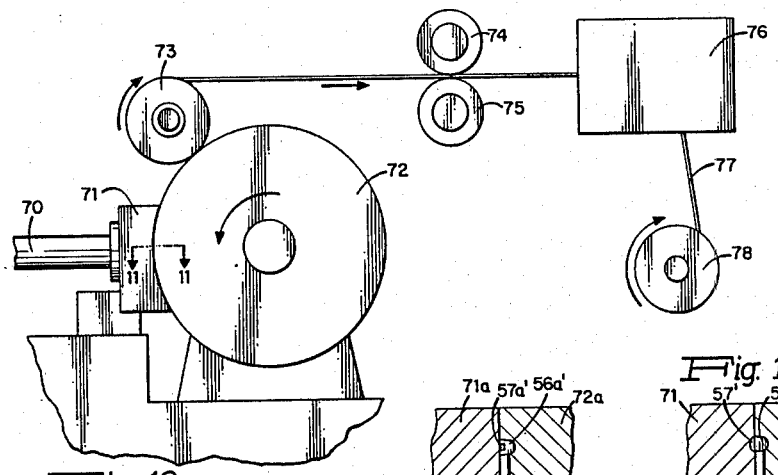
FIG. 10 is a schematic view of continuous molding apparatus.
Figure 11:
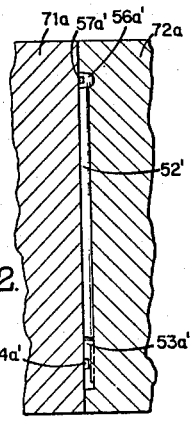
FIG. 11 is a section along the lines 11—11 of FIG. 10 illustrating molding apparatus to make the embodiment shown in FIG. 1.
Figure 12:
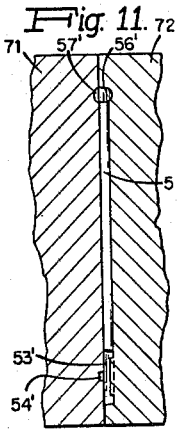
FIG. 12 is an alternate section along the lines 11—11 of FIG. 10 illustrating molding apparatus for making the embodiment shown in FIG. 7.

Each of the foregoing embodiments of fastener stock are especially adapted for continuous molding and for feeding and dispensing as hereinafter described. Continuous molding of plastic parts is known and is disclosed for example in U.S. Pat. Nos. 3,085,292; 3,196,196; 3,515,778; and numerous others; and is schematically illustrated in FIGS. 10–12. Heated plastic is extruded from extruder 70 through orifices in platen 71 into cavities in the periphery of rotating molding wheel 72. After cooling, the continuously molded parts are removed from molding wheel 72' by take-off roller 73 and feed rolls 74, 75, stretched if desired at 76 by any suitable apparatus, and the stock 77 wound onto take-up roll 78. Stretching can be omitted or separately performed if desired.

As shown in FIG. 11, cavities 52', 56' and 53' are provided in the periphery of molding wheel 72 for the filaments 52, end-bars 56, and tabs 53, respectively. Connectors 54 and 57 are provided as continuous runner cavities 54' and 57' in the platen 71. Tabs 53 may be of the same or different thickness from the thickness of the filaments 52 as desired. As shown in FIG. 12, connectors 54*a* and 57*a* may be provided by grooves 54*a*' and 57*a*' in the periphery of molding wheel 72*a* between fastener cavities.

By comparing FIGS. 10–12 with FIGS. 1–9, it will be seen that the plane 58 is defined by the meeting surface of the platen 71 and the wheel 72. It should be understood that the dimensions previously described refer to the fastener assemblies as they are molded. If the filaments are thereafter stretched, as preferred and as described in the foregoing patents, the edges of the flat plane 58 may be rounded somewhat in stretching but the filaments will maintain their general cross-sectional shape. End-bars 56 and tabs 53 are generally not stretched. Some distortion from shrinkage and cooling may also be noted.

The preferred apparatus employing the method of the present invention is a hand-actuated dispensing gun as shown in FIGS. 13–22. The gun 100 comprises a hollow casing 102 preferably of molded plastic in two halves joined together in any suitable manner. Affixed to the casing 102 is vertical extension 104 to which is affixed a projecting rod 106 about which a spirally wound assembly of fasteners may be secured. The fastener stock may be retained on the rod 106 by means of spring loaded detents 108 and 110 which may be folded towards each other for insertion of the fastener stock and moved to a vertical disposition for retention. The free end of the fastener assembly stock, with the plane 58 facing upwardly as hereinafter described, is then fed over the periphery of feed wheel 112 which is journaled for rotation within the casing 102. Wheel 112 has means such as notches 114 about its periphery for receiving fastener filaments 52 and advancing them in an arcuate path about the wheel to a position adjacent the rear end of forwardly projecting needle 116. Wheel 112 is spaced from the inner wall of casing 102 to define a passageway for receiving and guiding fastener end-bars 56 as the wheel rotates. Casing 102 has a projection 115 over hanging wheel 112 to aid in restraining the end-bars for travel within the provided passageway. Detent pin 118 is mounted to casing 102 and is biased to restrain backward movement of wheel 112 by means of spring 120. Notches 114 are spaced about the periphery of the wheel 112 equal to the spacing between successive fastener filaments 52.

Figure 17:
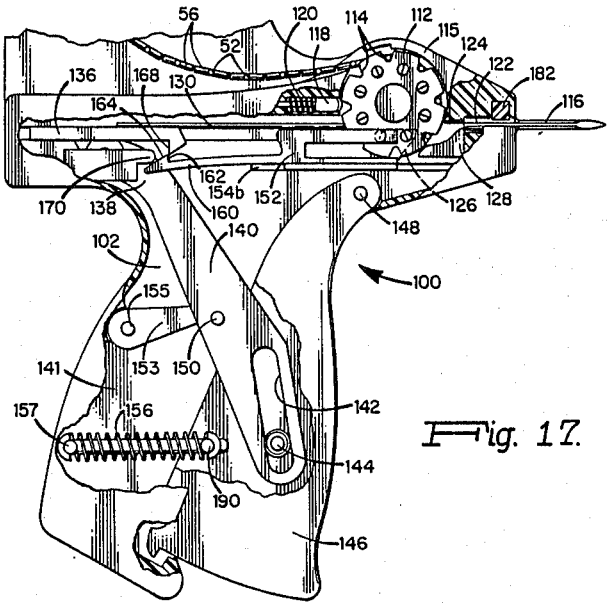
FIG. 17 is a view similar to FIG. 15 showing the trigger return stroke.
Figure 15:
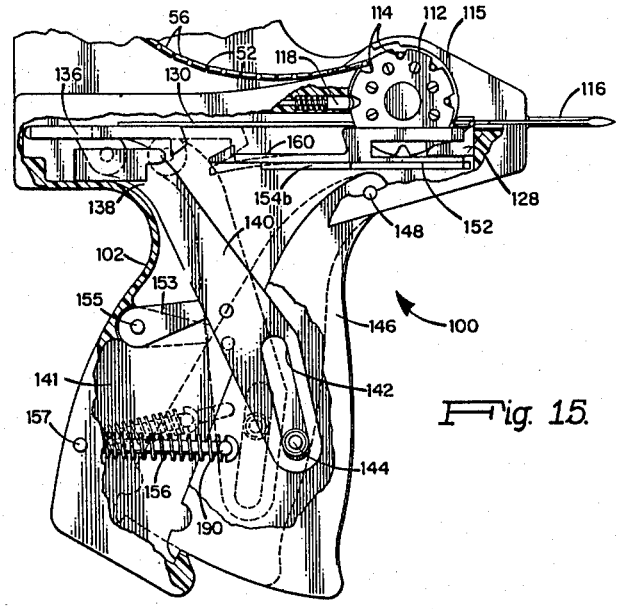
FIG. 15 is a plan view of the apparatus of FIG. 13 with portions of the casing broken away to show the operative interior mechanism, broken lines illustrating partial compression of the trigger to actuate the mechanism.
Figure 16:
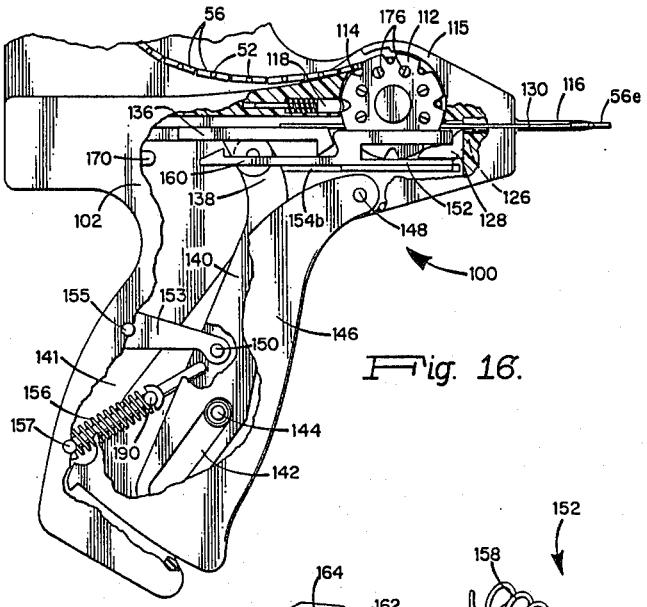
FIG. 16 is a view similar to FIG. 15 showing the trigger compressed.
Figure 19:
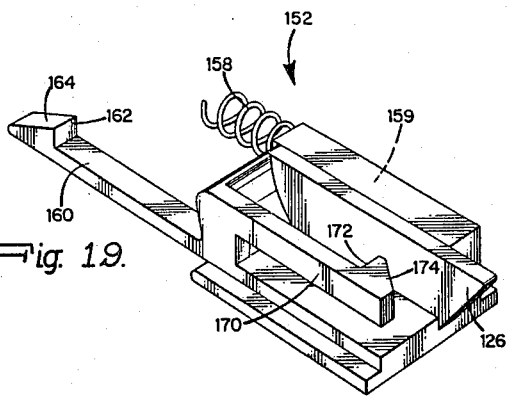
FIG. 19 is a perspective view of the cam slide of the apparatus of FIG. 18
Figure 20:
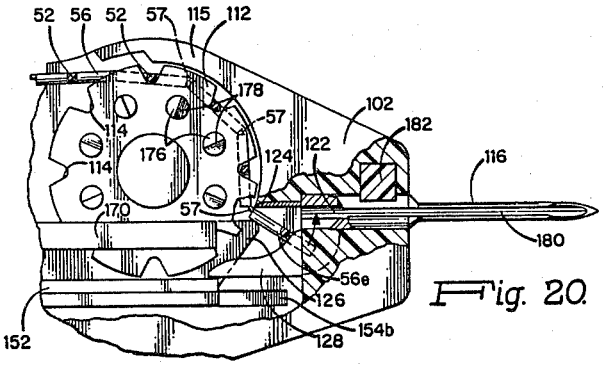
FIG. 20 is a side view of a portion of the needle, feed wheel and aligning cam illustrating the alignment of a fastener end-bar with the needle bore.
Figure 18:
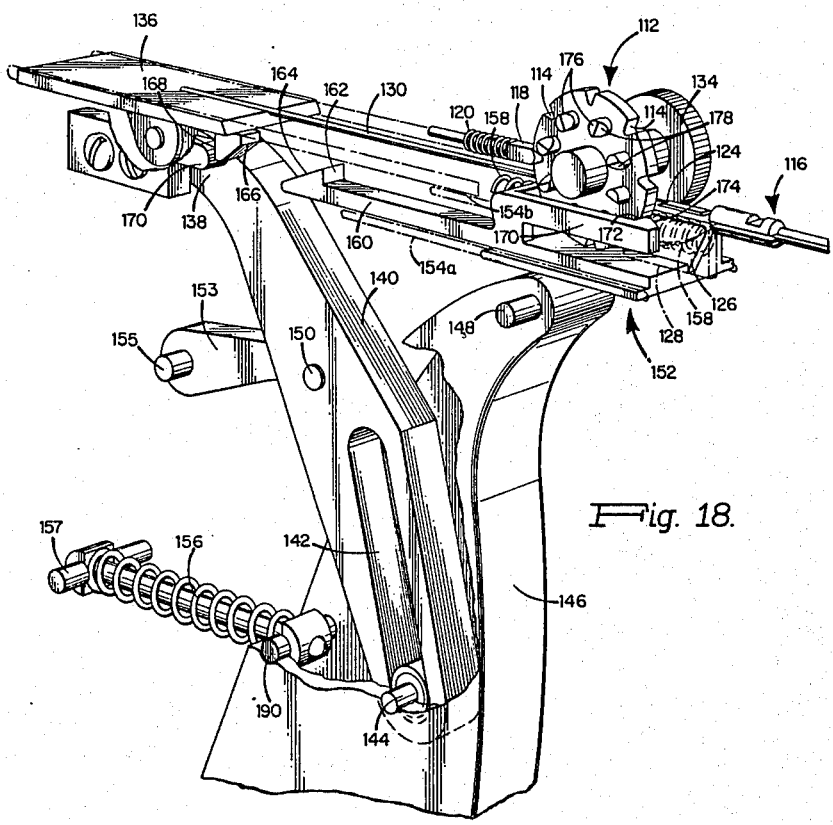
FIG. 18 is a perspective view of the embodiment shown in FIGS. 13–17 showing the operative internal mechanism.
Figure 21:
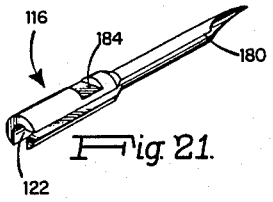
FIG. 21 is a perspective view of a hollow slotted needle useful with the present invention; and, FIG. 22 is a perspective view of a needle and needle retaining pin.
Figure 22:
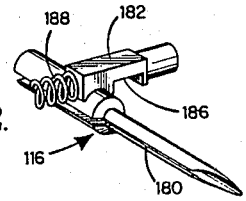

As shown for example in FIGS. 17 and 20, the end-most fastener end-bar **56*e* is indexed about the feed wheel 112 to a position transverse to the rear end of the bore 122 of the needle 116. A severing edge 124 may be secured to the needle or to the casing opposite the connection 57 connecting end-bar 56*e* with the end-bar of the next following fastener. As shown for example in FIG. 20, reciprocating cam means 126 is then advanced to rotate the end-most end-bar 56*e* about its connector as a hinge into alignment with the bore of the needle. A projecting tab 128 is provided in the casing in the vertical plane of wheel 112 forming an extension of the passageway about the wheel for the end-bars to guide the same during rotation. Tab 128 has a curved upper surface configured to guide the filament projecting from the wheel as the end-bar 56*e*** is rotated into alignment.

Figure 13:
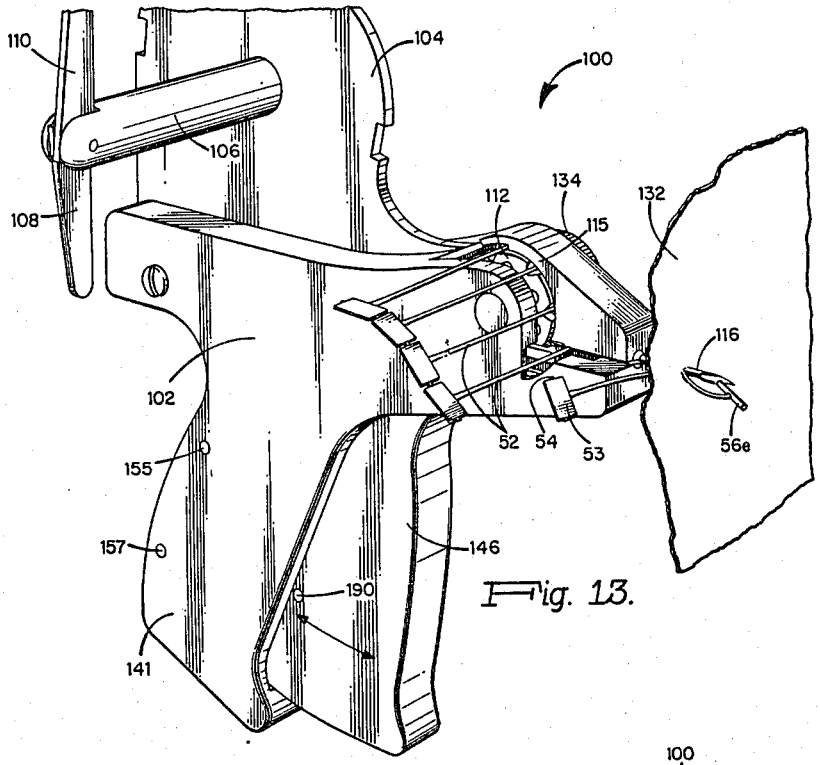
FIG. 13 is a perspective view of the preferred embodiment of the dispensing apparatus of this invention, illustrating insertion of a fastener through woven material.
Figure 14:
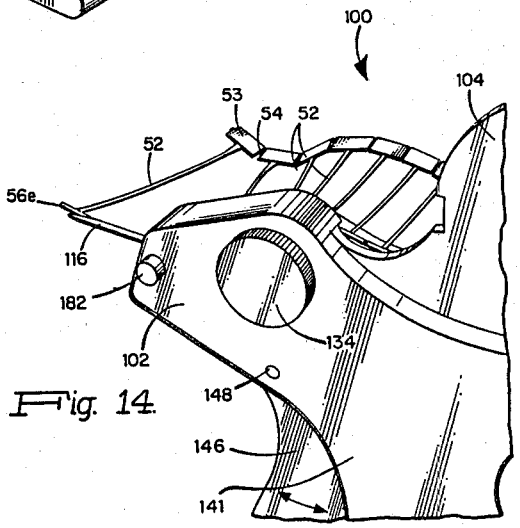
FIG. 14 is another perspective view of the apparatus of FIG. 13.

After the end-bar is aligned with the needle bore 122, a plunger 130 is brought forward to contact the free rear end of aligned end-bar **56*e* to push it through the hollow needle bore, simultaneously breaking or cutting connector 57 at severing means 124. As illustrated in FIG. 13, the plunger drives the end-bar through the hollow needle which, if inserted through one or more layers of material 132 will secure them together or will secure a tag thereto. As the needle is withdrawn from the material 132, end-bar 56*e* will resiliently resume its transverse position with respect to the filament to prevent withdrawal of the filament from the material. Motion of the tool as it is removed from the material 132 will break the connector 54 joining tab 53 to the next following tab in the manner illustrated for example in U.S. Pat. No. 3,733,657. For this purpose, connector 54** should be relatively weak. Any other suitable means for severing may also be provided.

A knob or knurled wheel 134 is provided on the exterior of the casing 102 to turn the feed wheel 112 for feeding fastener stock into and out of the apparatus.

Plunger 130 is fixed at its rearward end to a rear slide or plunger support 136 which slides back and forth within slide grooves in the casing to reciprocate the plunger in and out of the needle boe 122. Slide 136 is pivotally joined to the upper end 138 of lever member 140 which extends downwardly into the hollow handle portion 141 of the casing 102. The lower end of lever member 140 is secured by means of slot 142 to a pin 144 carried by hollow trigger 146 which is pivotally joined at 148 to casing 102 for movement back and forth within hollow handle 141. Pin 144 acts as a cam and the wall of slot 142 as a cam follower to impart motion to the lever member 140. Member 140 is joined intermediate its ends to a floating pivot 150 which is secured to one end of member 153, the opposite end of which is pivotally secured at 155 to the handle 141. Trigger 146 is biased in the open position by means of compression spring 156 described more fully hereinafter. Lever member 140 is biased by the spring 156 to retain the plunger support 136 in its rearward position. Upon squeezing the handle 141 and trigger 146, member 140 pivots about floating pivot point 150 to actuate support 136, causing it to slide from its rearward to its forward position, pushing the plunger through the needle bore 122 and ejecting a fastener end-bar through the needle. Plunger 130 is withdrawn from the needle bore by the energy stored in spring 156 when pressure on the trigger is released.

A forward slide 152 is mounted in the forward end of casing 102 and slides back and forth in slide grooves **154*a* and 154*b* in the casing. Slide 152 has a recess 159 which, together with the interior wall of the casing, houses a compression spring 158 which constitutes means for biasing the slide 152 in its forward position. Slide 152 has a rearwardly extending flexible arm 160 which has at its rearward end a detent surface 162 and an inclined cam surface 164. Plunger support 136 carries a cooperating cam surface 166 and detent surface 168 which actuates slide 152 as follows. When the trigger 146 is squeezed, and lever member 140 is actuated to advance plunger support 136, cam surface 166 rides up and over cam surface 164, deflecting flexible arm 160. On the return stroke of plunger support 136, detent surfaces 162 and 168 engage as shown for example in FIG. 17 and the plunger support 136 then moves slide 152 rearwardly, compressing biasing spring 158**.

As the plunger support 136 approaches its rearward position, a fixed cam 170 mounted to the casing engages a rearward extension of cam surface 164 which deflects arm 160 downwardly until the detent surfaces 162 and 168 are disengaged. Upon such disengagement, compressed biasing spring 158 causes slide 152 to return to its forward position. Cam 126 is carried by the slide 152 and on its forward stroke rotates end-bar **56*e* into alignment with the needle bore 122**.

Slide 152 has a second forwardly extending resilient arm 171 which has a rearwardly facing detent surface 172 and a forward cam surface 174. Feed wheel 112 is provided with cooperating index pins 176, one for each indexing position, each of which has a cam surface 178. As the slide 152 is drawn rearwardly by plunger support 136, cam surface 172 engages a pin 176 to rotate feed wheel 112 and feed the next fastener into position with its end-bar transverse to the longitudinal axis of the needle bore. On the return forward stroke of slide 152, cam surface 174 rides up and over cam surface 178 of the lower pin 176 to deflect arm 171 and allow its passage into its forward position ready for the next indexing stroke.

The needle 116 can be a hollow slotted needle of any known type suitable for feeding flexible fasteners, the fastener end-bar being dispensed through the hollow bore of the needle and the filament extending through the sliding within the communication slot 180. Needle 116 is preferably removably secured to the forward end of the casing 102 by means of a pin 182 which engages a corresponding cut-out 184 in the needle 116. Pin 182 is also provided with a cut-out slot 186 which provides a passageway for insertion and removal of the needle. Pin 182 is biased in its locking position by means of spring 188 mounted in the casing. When the pin is pushed toward spring 188 to compress it, slot 186 aligns with the needle to free it for removal. Preferably the portion of the pin 182 engaging needle cut-out 184 in locking position is rectangular or square in cross-section.

In a hand-actuated dispensing gun of the type described, it is desirable that the actuating force to operate the device be as small as possible to avoid operator fatigue. The movable linkage disclosed in U.S. Pat. No. 3,893,612 is preferably employed for mechanical advantage as described. In addition, it is desirable that the compression force required decrease as the trigger is depressed. Such decreasing force is provided by the spring arrangement shown. The rear end of spring 156 is secured to a fixed pivot 157 in the handle 141. The forward end of the spring however is fixed to a movable pivot 190 which is secured to trigger 146 and moves therewith as the trigger is depressed. Movable pivot 190 is so located that in its normal extended position, an extension of the centerline or longitudinal axis of the spring 156 is located a substantial distance from the fixed pivot 148. As the trigger is depressed, this centerline moves with pivot 190 into a position closer to pivot pin 148 thereby decreasing the moment arm, the compressive force required, and the extend of compressive motion of the spring, all in a smooth and continuous manner.

It should be noted that the apparatus described is readily assembled from molded or other easily fabricated parts, requires modest actuating force for hand operation, is positive in action, and is adapted to feed long lengths of fastener stock. It should be further noted, for example by reference to FIG. 20, that the coiled fastener stock has the connectors 57 or **57*a* facing outwardly at the free end for feeding over the periphery of the feed wheel. This places the connector during rotation of the end-bar 56*e* into alignment with the needle bore in position to act as a hinge, to engage the severing edge 124**, and to expose the majority of the end-bar end-section to the plunger as the plunger is actuated to dispense the end-bar through the needle.

The operation of the apparatus described comprises the following sequence:

(1) A coil of fastener stock is placed over pin 106, or an alternative holder of fan-folded stock as shown in FIG. 12 of U.S. Pat. No. 3,875,648, connectors 57 and plane 58 at the free end facing upwardly. The free end is fed over feed wheel 112 and knob 134 is rotated until the end fastener **56*e* rests against the upper surface of cam 126**.

(2) Trigger 146 is squeezed against handle 141 to rotate lever member 140 about pivot 150, thereby compressing return spring 156 and sliding plunger support 136 forward, cam surface 166 sliding over and deflecting cam surface 164.

(3) Trigger 146 is released, spring 156 causing support 136 to return to its rearward position. As support 136 returns, slide 152 is moved to its rear position and spring 158 is compressed until cooperating detents 162 and 168 are disengaged by deflection of arm 160 by cam surfaces 170 and 164. On the rearward stroke of slide 152, detent 172 on arm 171 engages pin 176 of feed wheel 112 to index the wheel and feed end-bar **56*e* to the position shown in FIG. 17. As slide 152 returns to its forward position, cam surfaces 174 and 178 engage to deflect arm 170, and cam 126 rotates end-bar 56*e* about connector 57 into alignment with needle bore 122 as shown in FIG. 20**.

(4) Trigger 146 is again squeezed to move plunger support 136 and plunger 130 fowardly to engage the exposed end of end-bar **56*e* and dispense it through the bore 122, edge 124 severing the connector 57**.

(5) As trigger 146 is again released, the sequence described in (3) above is repeated to prepare the next end-bar for dispensing.

While the apparatus described is well adapted for hand operation, the operations may be powered by any suitable means, for example, by means of electrical devices or fluid pressure. Such means are described for example in the aforementioned U.S. Pat. No. 3,875,648. And while the novel fastener stock herein described is well adapted for use in the method and apparatus described, other suitable fastener stock can be employed. The novel fastener stock may also be dispensed by means of other suitable apparatus, for example as disclosed in U.S. Pat. No. 3,875,648.

It should be further understood that the present invention includes all modifications and equivalents within the scope of the appended claims.

What is claimed is:

1. In fastener stock of the type comprising two continuous and elongated plastic side members that are cross-coupled by a plurality of filaments, the stock being proportioned to be fed as a unit to a position where individual fasteners are separated therefrom within a machine, one of said side members being proportioned so that each separated fastener includes an end-bar formed from a portion of the said side member and is configured for feeding through the bore of a hollow needle having a longitudinal slot for passage of the associated filament, and in which each filament is foldable towards the associated end-bar that is feedable through said hollow needle; the improvement adapted for continuous molding in long lengths and for feeding and dispensing individual fasteners therefrom with dispensing apparatus which advances the end fastener adjacent the rear portion of the needle bore with its end-bar transversely disposed thereto, rotates the end-bar into alignment therewith, and contacts the end of the end-bar with plunger means to sever the end-bar from the stock and force it through the bore; said improvement comprising fastener stock wherein each of said filaments is molded with a D-shaped cross-section having its maximum width at a substantialy flat plane at one side thereof, said end-bars being wider in cross-section at said plane than in other planes parallel thereto, and wherein adjacent end-bars are connected end-to-end at a portion of their peripheries adjacent to said plane by means of a severable connector substantially smaller in cross-sectional area than said end-bars to expose a major portion of the end of at least one of the connected end-bars, one face of each of said connectors being located substantially at said plane.

2. Fastener stock according to claim 1 wherein each of said connectors extends from said plane on the same side thereof as said filaments.

3. Fastener stock according to claim 1 wherein each of said connectors extends from said plane on the side thereof opposite from said filaments, the section thereof being continued along the length of each end-bar to form a continuous running section along the length of said side member.

4. Fastener stock according to claim 4 wherein said end-bars are rounded in cross-section from said plane.

5. Fastener stock according to claim 1 wherein the other side member is proportioned to form an enlarged end for each filament, adjacent enlarged ends thereof being joined end-to-end by severable connectors, each of the connectors being substantially smaller in cross-sectional area than said enlarged ends.

6. An assemblage of connected fasteners in accordance with claim 1 comprising a first side member constituted by a longitudinally connected set of paddle members, a second side member constituted by a longitudinally connected set of end bars, and a filamentary cross link coupling each paddle to each end bar, and a longitudinal portion of each cross link having a continuous planar configuration.

7. An assemblage of connected fasteners in accordance with claim 6 wherein each cross link has a portion thereof with a continuous planar configuration.

8. An assemblage of connected fasteners in accordance with claim 7 wherein the continuous planar configuration of each cross link extends from a paddle member to an end bar.

9. An assemblage of connected fasteners as defined in claim 6 wherein the connections of said paddle members and said end bars are contiguous therewith.

10. An assemblage of connected fasteners as defined in claim 6 wherein the connections of said paddle members and/or said end bars form a continuously running section that is elevated above said paddle members or said end bars.

* * * * *